US007124702B1

(12) United States Patent
Cameron

(10) Patent No.: US 7,124,702 B1
(45) Date of Patent: Oct. 24, 2006

(54) FISHING KAYAK WITH A DEPLOYABLE FAN-TAIL

(76) Inventor: David B. Cameron, 8757 Winans Lake Rd., Brighton, MI (US) 48116

( * ) Notice: Subject to any disclaimer, the term of this patent is extended or adjusted under 35 U.S.C. 154(b) by 0 days.

(21) Appl. No.: 11/198,941

(22) Filed: Aug. 5, 2005

(51) Int. Cl.
*B63B 7/04* (2006.01)

(52) U.S. Cl. ..... 114/352; 114/347

(58) Field of Classification Search ..... 114/61.1, 114/61.15, 61.16, 61.17, 61.18, 123, 343, 114/347, 352
See application file for complete search history.

(56) References Cited

U.S. PATENT DOCUMENTS

| | | | | |
|---|---|---|---|---|
| 883,588 | A | | 3/1908 | Thatcher |
| 1,683,276 | A | * | 9/1928 | Woods ..... 114/61.16 |
| 3,960,102 | A | | 6/1976 | Davy |
| 4,159,006 | A | | 6/1979 | Thurston |
| 4,172,426 | A | | 10/1979 | Susman |
| 4,213,412 | A | | 7/1980 | Jamieson |
| 4,286,533 | A | | 9/1981 | Sanner |
| 4,294,184 | A | | 10/1981 | Heinrich |
| 4,366,769 | A | * | 1/1983 | Lingeman ..... 114/352 |
| 4,465,008 | A | | 8/1984 | Liggett |
| 4,838,196 | A | | 6/1989 | Ingram |
| 4,898,113 | A | | 2/1990 | Tapley et al. |
| 5,373,799 | A | * | 12/1994 | Green ..... 114/61.18 |
| 5,542,369 | A | | 8/1996 | Ingram |
| 5,582,126 | A | * | 12/1996 | Rypinski ..... 114/352 |
| 5,647,294 | A | * | 7/1997 | Finley ..... 114/123 |
| D385,528 | S | | 10/1997 | Cronin |
| 5,704,310 | A | | 1/1998 | Cittadini |
| 6,000,355 | A | | 12/1999 | Hall |
| 6,070,544 | A | * | 6/2000 | Finley ..... 114/61.1 |
| 6,073,568 | A | | 6/2000 | Finley |
| 6,129,600 | A | | 10/2000 | Nordby |
| 6,343,562 | B1 | | 2/2002 | Ingram |
| 6,871,611 | B1 | | 3/2005 | Tormey et al. |

* cited by examiner

*Primary Examiner*—Lars A. Olson
(74) *Attorney, Agent, or Firm*—Harness, Dickey & Pierce, P.L.C.

(57) ABSTRACT

A water vessel has a hull having a maximum width and defines a first portion and a second portion. Each of the first and second portions has an end at which a width of the hull converges relative to the maximum width of the hull. The second portion has a first member defining a first end and a second end. The first end is moveably coupled to the first portion of the hull. The second end is associated with the end of the second portion. The first member is movable between a closed position and an open position relative to the first portion of the hull.

18 Claims, 15 Drawing Sheets

FISHING KAYAK WITH A DEPLOYABLE FAN-TAIL

FIELD

The present invention relates to a water vessel and more particularly relates to a fishing kayak with a deployable fan tail.

BACKGROUND

Fishing and kayaking have become popular activities. Fishing from a kayak presents many benefits, especially in small, shallow water locations. The kayak is a very maneuverable craft and by its nature can be easily rolled from side to side. While the ability to easily roll the kayak may present benefits in certain kayaking environments, the propensity to roll the kayak may be less beneficial when a relatively stable platform is desired in other kayaking environments.

SUMMARY

The present teachings generally include a water vessel that has a hull having a maximum width and that defines a first portion and a second portion. Each of the first and second portions has an end at which a width of the hull converges relative to the maximum width of the hull. The second portion has a first member defining a first end and a second end. The first end is moveably coupled to the first portion of the hull. The second end is associated with the end of the second portion. The first member is movable between a closed position and an open position relative to the first portion of the hull.

Further areas of applicability of the present teachings will become apparent from the detailed description and the appended claims provided hereinafter. It should be understood that the detailed description includes specific examples and various embodiments of the present teachings but it is not intended to limit the scope of the teachings.

BRIEF DESCRIPTION OF THE DRAWINGS

The present teachings will become more fully understood from the detailed description, the appended claims and the accompanying drawings, wherein:

DETAILED DESCRIPTION OF THE VARIOUS EMBODIMENTS

The following description of the various embodiments is merely exemplary in nature and is in no way intended to limit the present teachings, their application, or uses.

Turning to the figures, the present teachings generally include a kayak 10 having a deployable fan tail 12. While a sit-on-top variety kayak is generally illustrated throughout the application, various kayak forms and/or other water vessels may be used including, but not limited to, sea kayaks, river kayaks, canoes, jet-skis, and/or other watercraft. The kayak 10 may be made from a suitable polymer and constructed using, for example, a roto-molding process. It will be appreciated that other materials and other forms of construction may be used including wood, fiberglass, carbon fiber and suitable combinations thereof.

Figure 1:
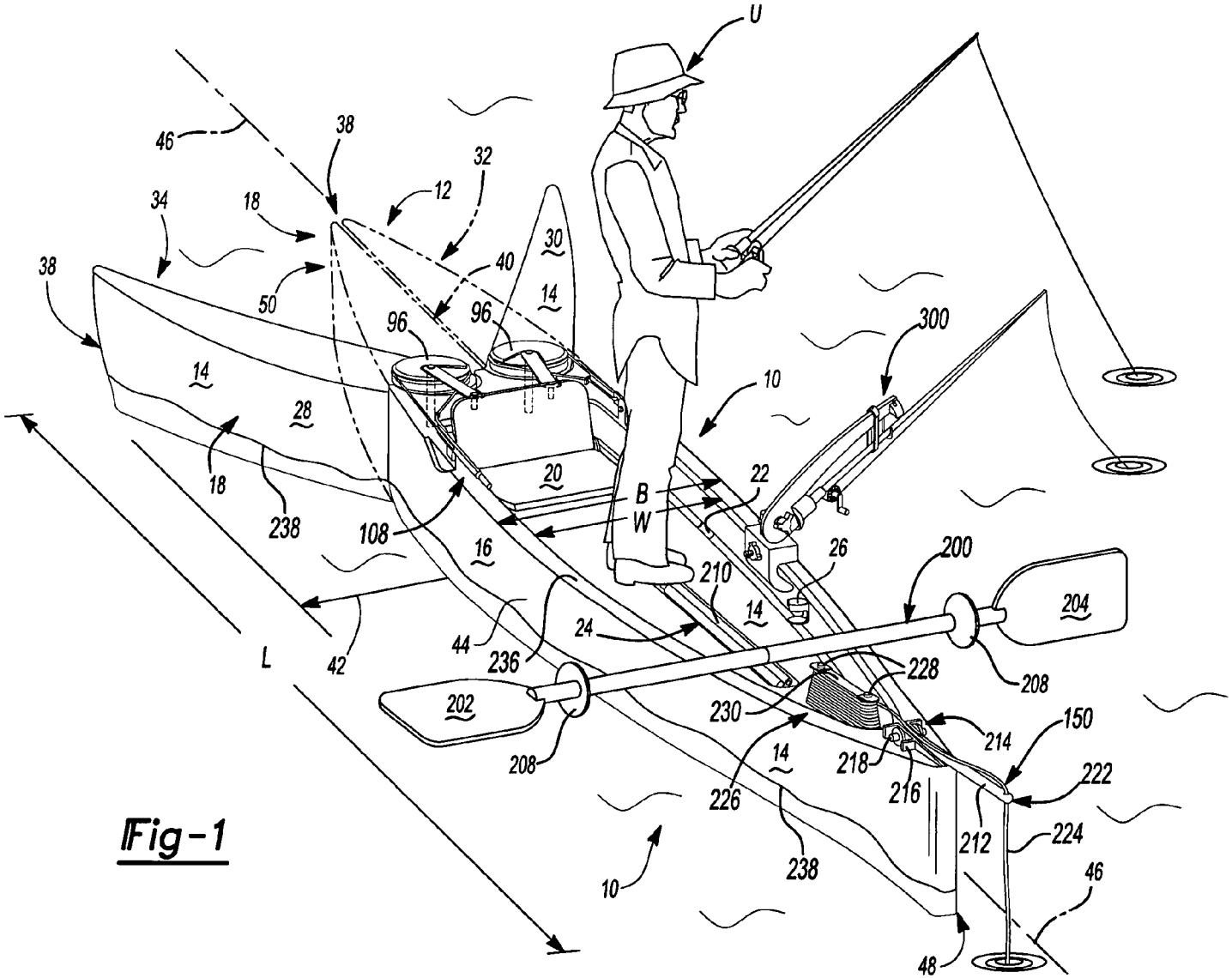
FIG. 1 is a perspective view of a fishing kayak constructed in accordance with the present teachings.
Figure 2:
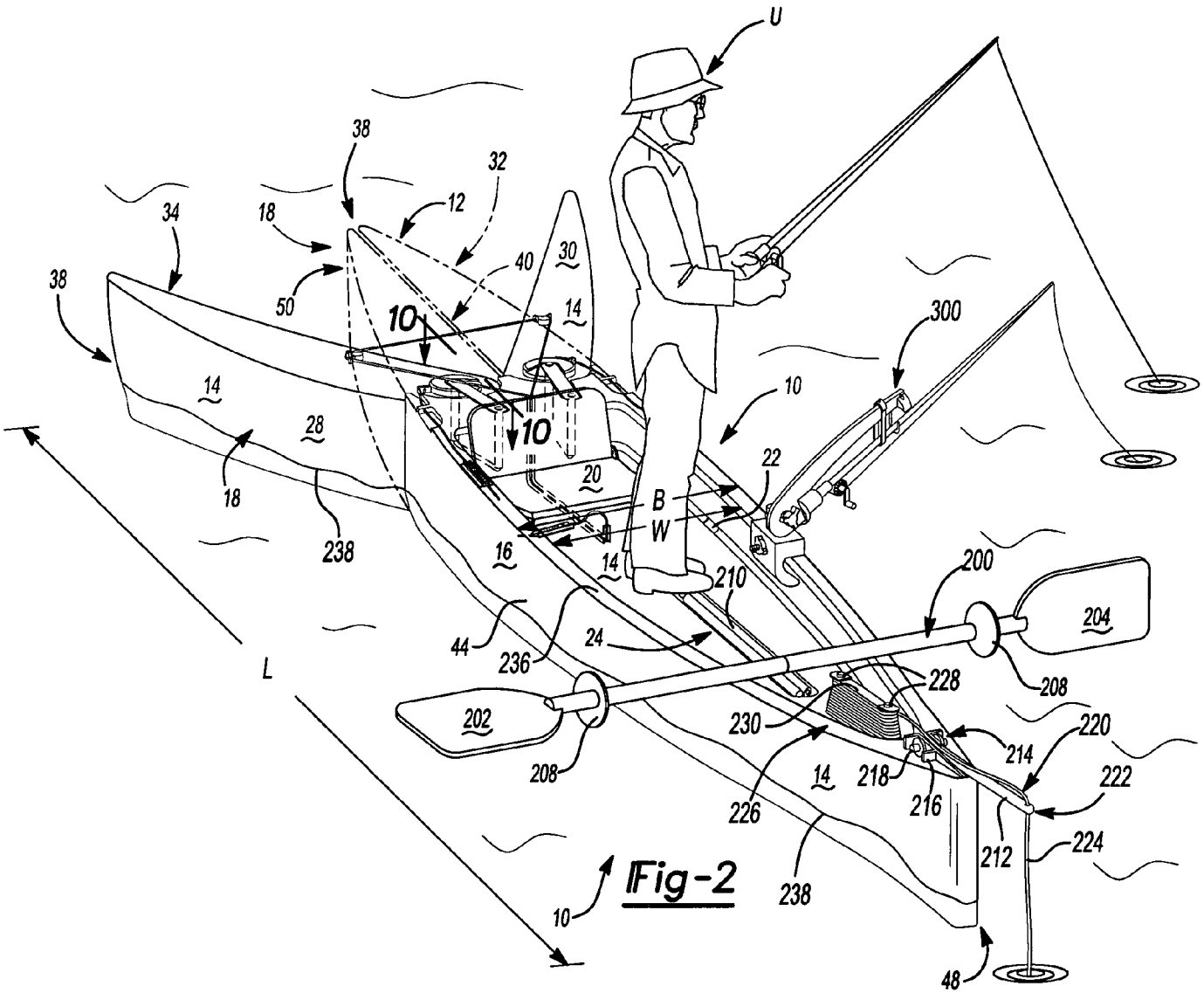
FIGS. 2 and 3 are perspective views of alternative constructions of the fishing kayak in accordance with the present teachings.
Figure 3:
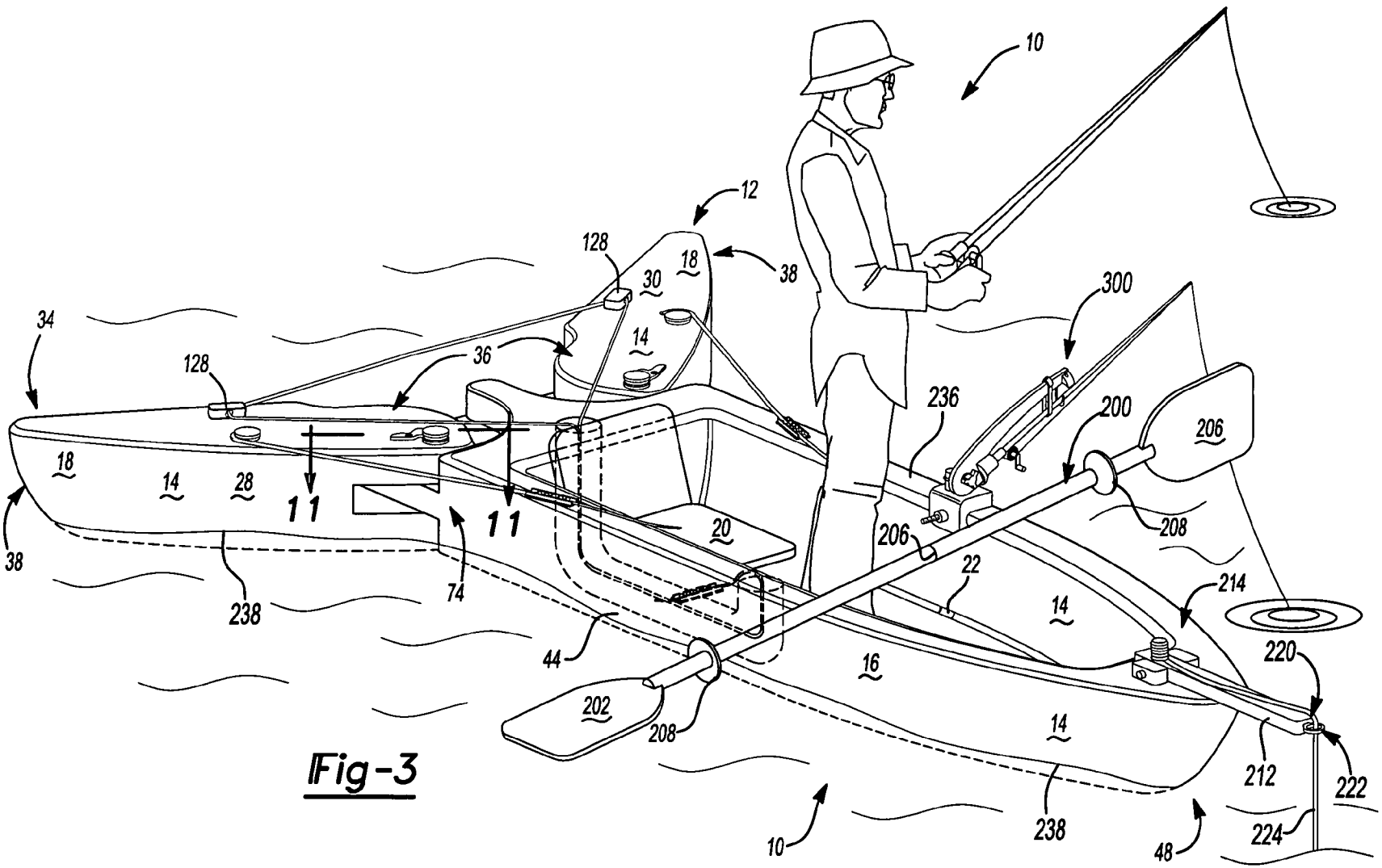

With reference to FIGS. 1–3, the kayak 10 generally includes a hull 14. The hull 14 may have two portions: a first or main hull portion 16 and a second hull portion 18. In one example, the second hull portion 18 is a stern portion. The first hull portion 16 may be configured to accommodate and cater to an angler or a user (U) of the kayak 10. The first hull portion 16 may also include, but is not limited to, a seat 20 (or seating area), one or more footrests 22, a pole and/or paddle storage compartment 24, and other holders, compartments, containers and/or reservoirs 26 for use and enjoyment by the angler or user (U). The above components may be integral with the kayak 10 or coupled to an appropriate position on or within the kayak 10.

The second hull portion 18 may define the deployable fan tail 12. The deployable fan tail 12 may include a first member 28 and a second member 30. The first member 28 and the second member 30 may each couple to and rotate about the first hull portion 16. More specifically, the first member 28 and/or the second member 30 may move to a closed, a cruising or a stowed position 32 (illustrated in FIG. 9 and in phantom in FIGS. 1, 2 and 8), to an open or a fan tail position 34 (illustrated in FIGS. 1, 2, 3 and 8 and in phantom in FIG. 9) and/or a plurality of positions therebetween.

The first member 28 and the second member 30 may each have a first end or a pivot end 36 (FIGS. 3 and 6) and a second end or a tip end 38. The pivot end 36 of each member 28, 30 may be rotatably coupled to the first hull portion 16 thus allowing the first member 28 and the second member 30, respectively, to pivot about the first hull portion 16. In the closed position 32, the tip ends 38 of the members 28, 30 may be similar to a traditional kayak stern but include a relatively narrow longitudinal gap 40 formed between the first member 28 and the second member 30.

In the open or fan tail position 34 and with reference to FIG. 1, the second ends 38 of the members 28, 30 may extend a lateral distance 42 away from a side 44 of the kayak 10. More specifically, the first ends 36 of the members 28, 30 may each pivot about the first hull portion 16 thus moving the second ends 38 between the closed position 32, which is about aligned with a longitudinal axis 46 of the kayak 10, to the open position 34, thus spaced from the longitudinal axis 46. It will be appreciated that the second ends 38 of the members 28, 30 may each be deployed at varying degrees between the open and closed positions 34, 32. In one example, the members 28, 30 may (or may not) move independently of one another. In other examples, the deployable fan tail 12 may be associated with a bow 48 of the kayak 10 rather than a stern 50. In further examples, the deployable fan tail 12 may be deployed on both the bow 48 and the stern 50 of the kayak 10.

Figure 4:
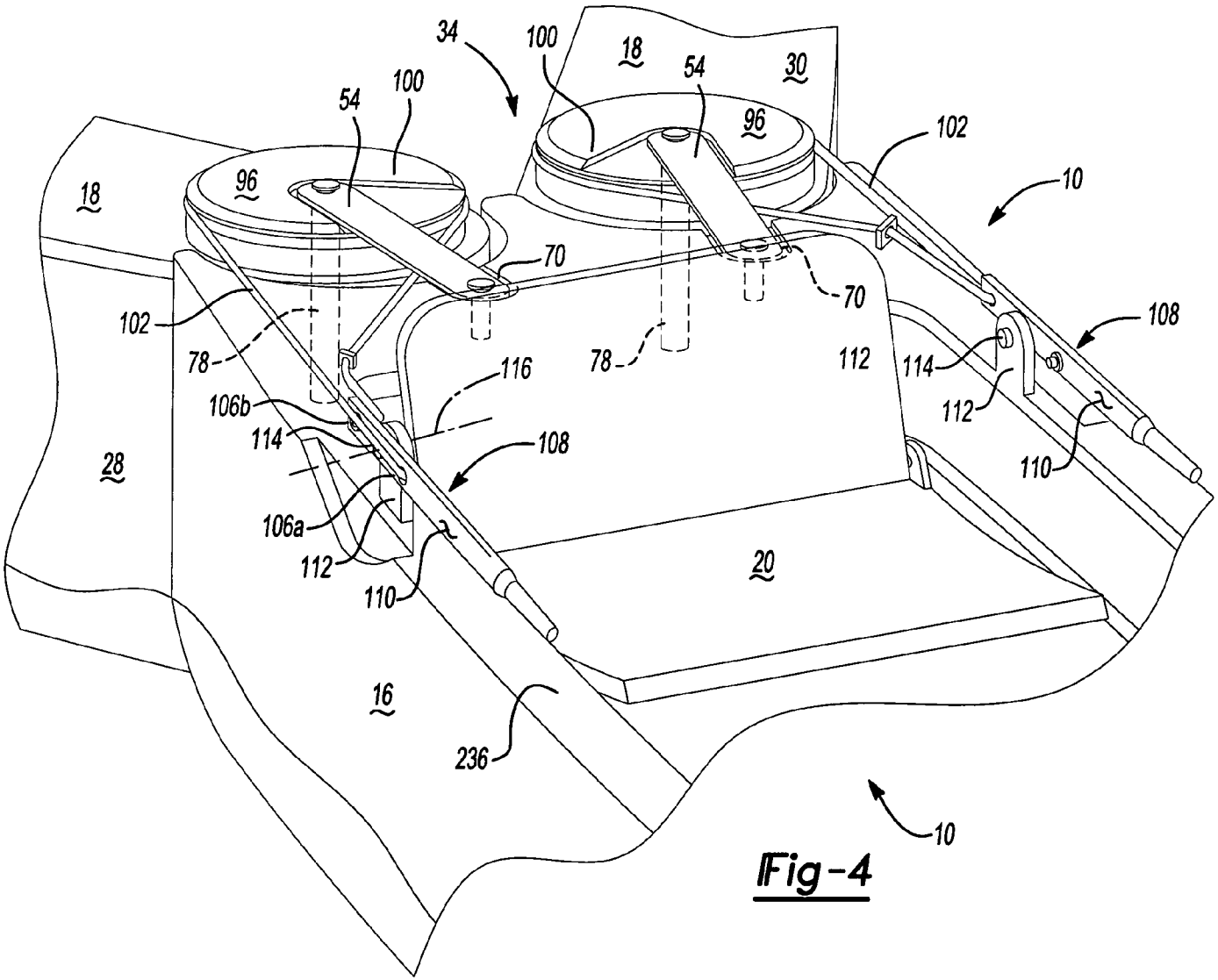
FIG. 4 is a partial view of the fishing kayak of FIG. 1 and shows a lever system connected to a deployable fan tail.
Figure 10:
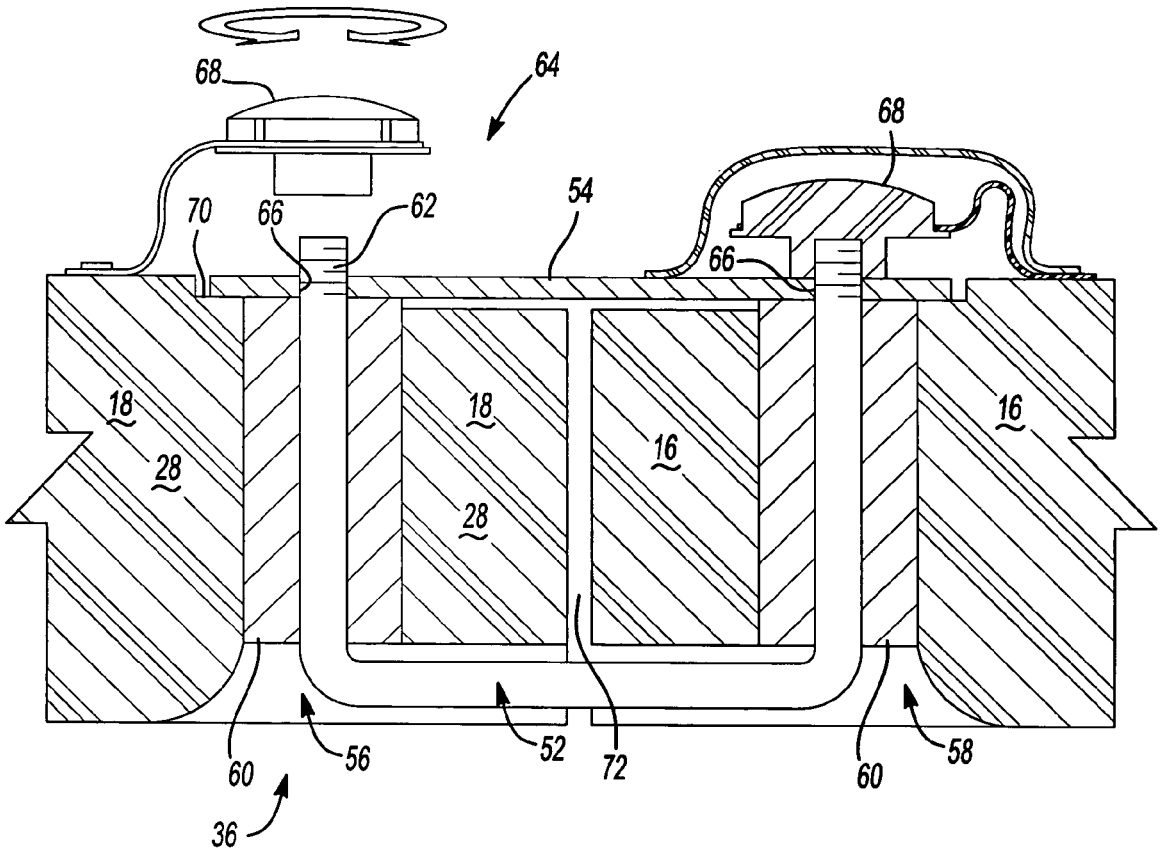
FIG. 10 is a partial cross-sectional view of a first hull portion coupled to a second hull portion of the fishing kayak of FIG. 2.

In one example and with reference to FIGS. 4 and 10, the first member 28 and the second member 30 may each couple to the first hull portion 16 with a fastener 52 and a plate 54. More specifically, an aperture 56 may be formed in the first end 36 of the members 28, 30 and associated apertures 58 may also be formed in the first hull portion 16. The fastener 52 may have an u-shape (e.g., a u-bolt) and may be passed through the apertures 56, 58. Suitable bushings 60 may (or may not) be disposed between portions of the fastener 52 in the apertures 56, 58 to facilitate movement of the members 28, 30. Ends 62 of the fastener 52 may protrude from a top 64 of the kayak 10 and may be received by complimentary apertures 66 formed on the plate 54. Caps 68 may couple to the ends 62 of the fastener 52.

In the first hull portion 16, channels 70 may receive a portion of the plate 54. The channels 70 may hold the plates 54 such that there may be relatively little motion of the plates 54 relative to the first hull portion 16. The members 28, 30 are attached to ends of the plate 54 not otherwise coupled to the first hull portion 16. In this arrangement, the members 28, 30 may rotate about a portion of the fastener 52 and the plate 54 as the members 28, 30 are moved from the open position 34, the closed position 32 and a plurality of positions therebetween. Moreover, the configuration of the fastener 52 allows a gap 72 to be maintained between the first hull portion 16 and the members 28, 30. The gap 72 may be sized and shown to prevent debris (e.g., rocks and/or sand from a riverbed) and other items from hindering motion of the members 28, 30.

Figure 9:
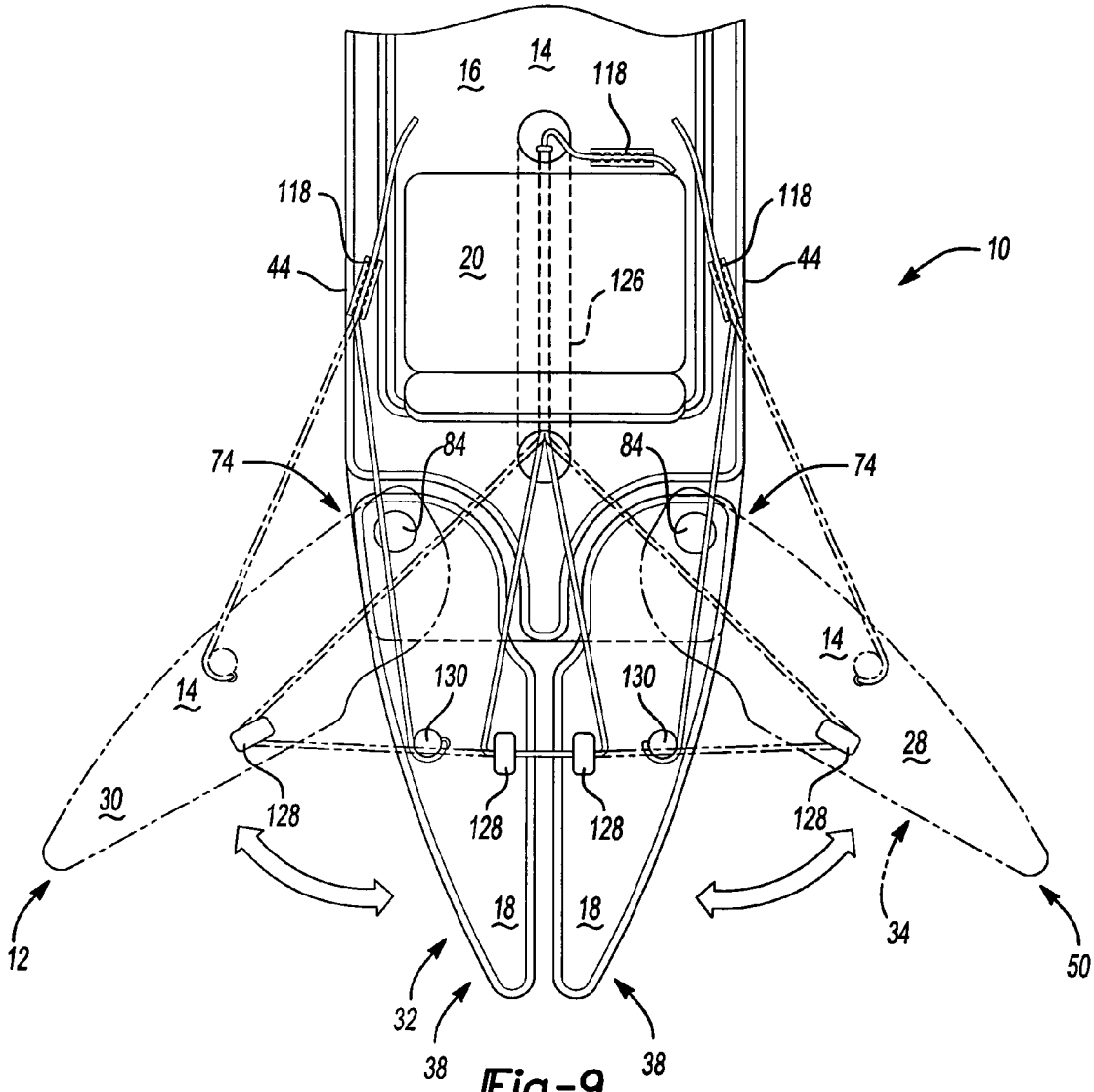
FIG. 9 is a partial top view of the fishing kayak of FIG. 3.
Figure 11:
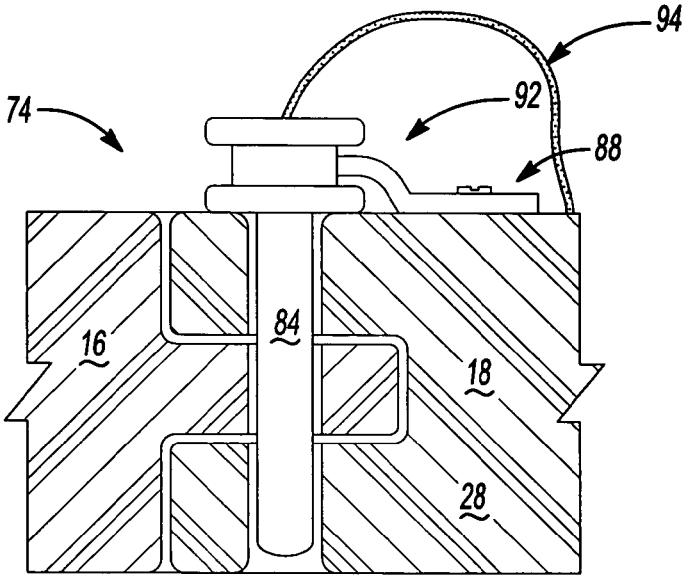
FIG. 11 is a cross-sectional view of the first hull portion coupled to the second hull portion of the fishing kayak of FIG. 3.
Figure 12:
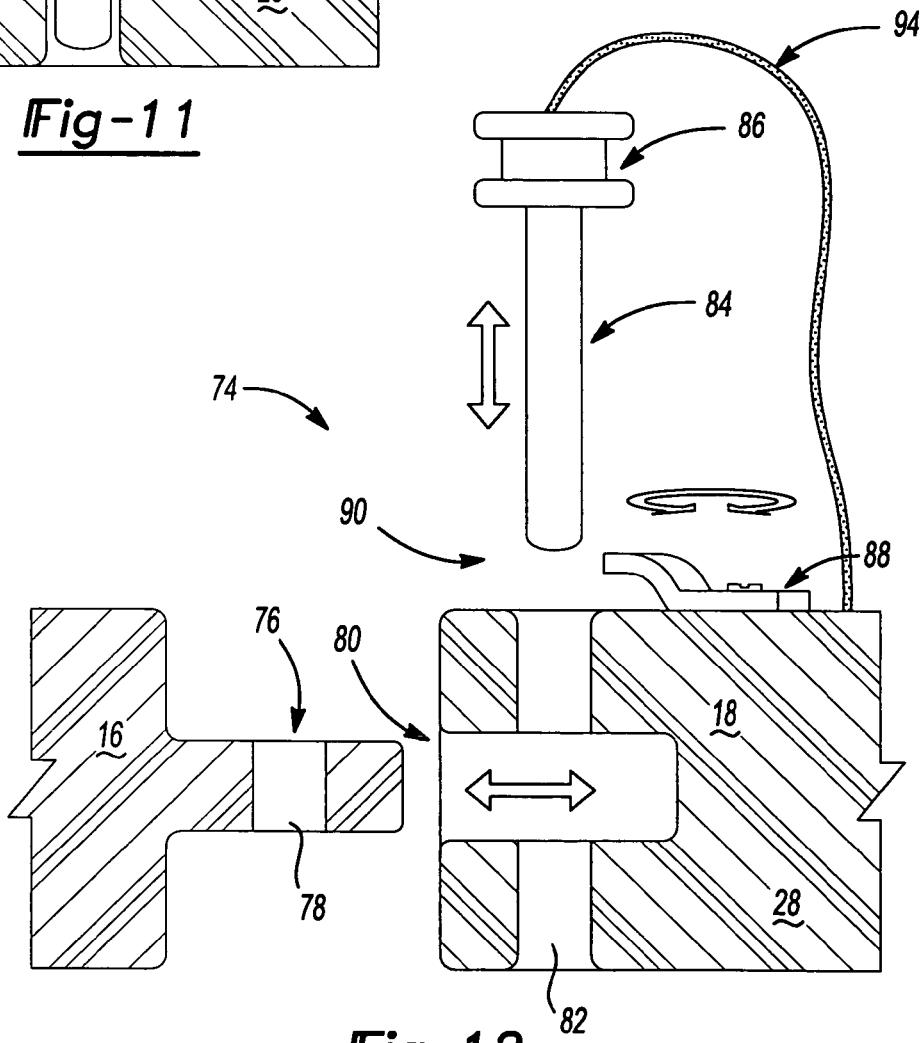
FIG. 12 is similar to FIG. 11 and shows the first hull portion uncoupled from the second hull portion.

In one example, and with reference to FIGS. 9, 11 and 12, the members 28, 30 may be coupled to the first hull portion 16 using a tongue and groove assembly 74. The assembly 74 may include a tongue 76 extending from (coupled to or integral with) the first hull portion 16. The tongue 76 may define an aperture 78. The members 28, 30 may each define a groove 80 that receives a portion of the tongue 76. Each of the members 28, 30 may define an aperture 82 formed through the groove 80 (i.e., intersects the groove 80).

To couple the members 28, 30 to the hull portion 16, the grooves 80 receive the respective portions of the tongue 76. A pin 84 may be received by the apertures 78, 82. The pin 84 permits the members 28, 30 to swivel about the first hull portion 16. In one example and with reference to FIGS. 11 and 12, the pin 84 may define a locking rim 86. The locking rim 86 may be engaged with a locking swivel 88. The locking swivel 88 may be moved between an unlocked position 90 and a locked position 92. In the locked position 92, the locking swivel 88 holds the pin 84 in the apertures 78, 82. In the unlocked position 90, the pin 84 may be removed. With the pin 84 removed, the tongue 76 may be removed from the groove 80 thus uncoupling the members 28, 30 from the first hull portion 16.

In one example, the pin 84 may be coupled to the kayak 10 with a tether 94, which may prevent loss of the pin 84 when uncoupling the members 28, 30 from the first hull portion 16. In one example and with reference to FIG. 10, the fastener 52, the plate 54, the bushings 60 and/or the caps 68 may be coupled to the kayak 10 with one or more tethers 94, which may prevent loss of the above items when uncoupling the members 28, 30 from the first hull portion 16, especially when afloat in the kayak 10.

In one example and with reference to FIGS. 4 and 6–8, each of the members 28, 30 may include a cam 96. The cam 96 may be about concentric with the aperture 78 (FIG. 4) formed in the first end 36 of the members 28, 30. The cam 96 may define one or more catches 98 and a stop 100. The cam 96, the catches 98 and/or the stop 100 may be integrally formed from the material that forms the members 28, 30, e.g., made from a single mold. In another example, the cam 96, the catches 98 and/or the stop 100 may be formed from separate pieces, e.g., a multiple component construction.

Figure 5:
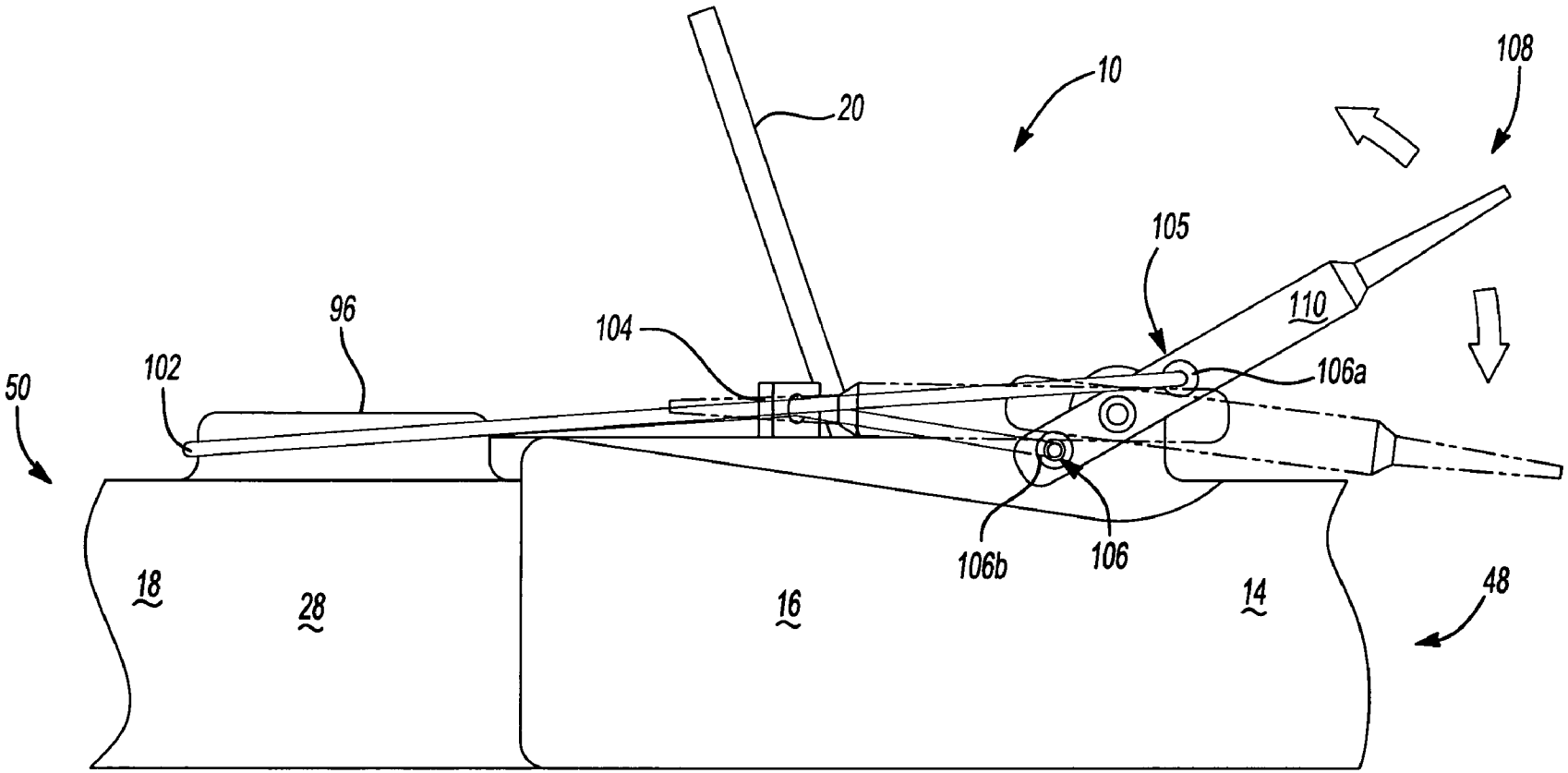
FIG. 5 is a partial side view of the fishing kayak of FIG. 1 showing positions of the lever system.
Figure 6:
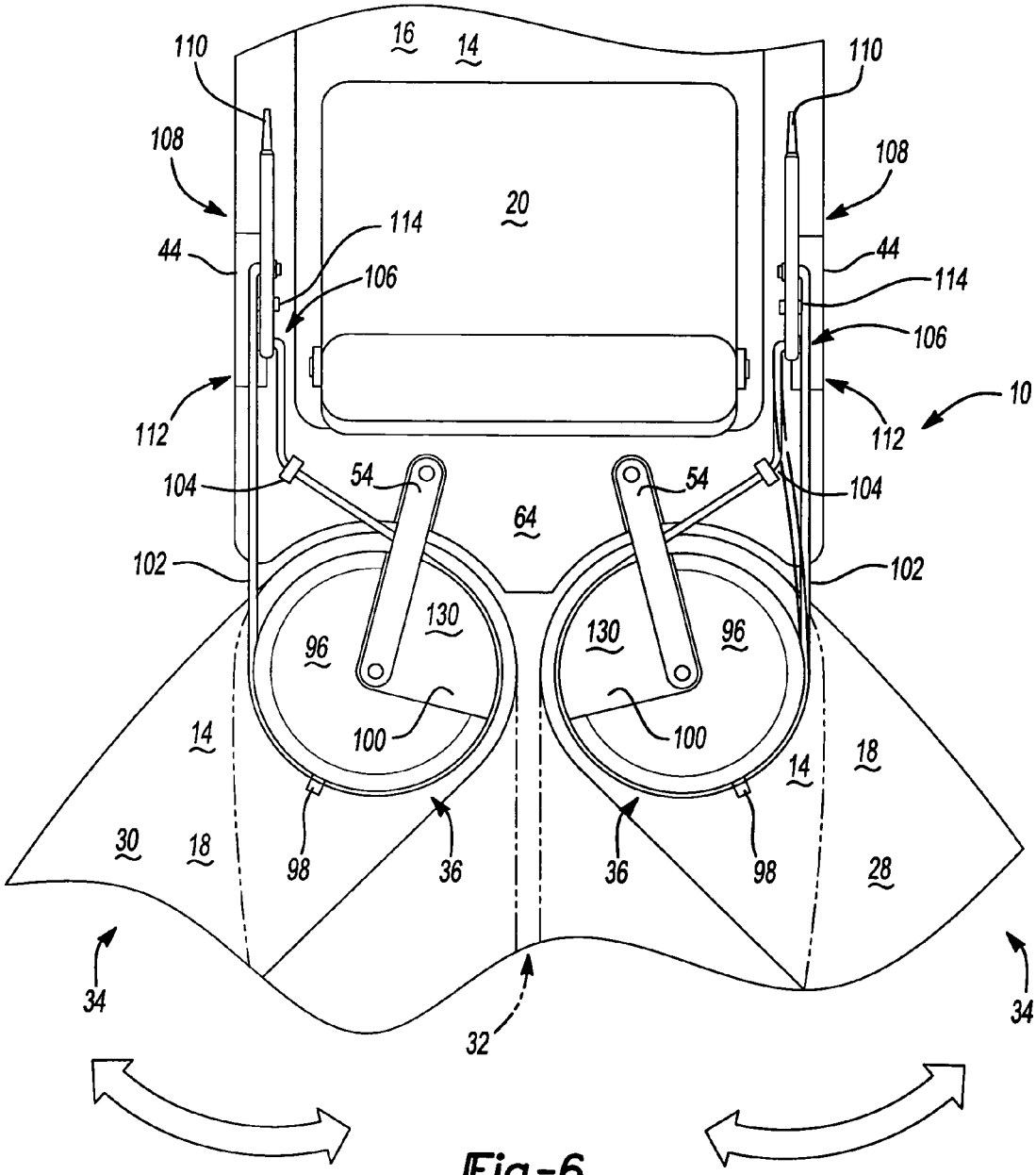
FIG. 6 is a partial top view of the fishing kayak of FIG. 1 showing the lever system and portions of the deployable fan tail.

With reference to FIGS. 4–6, a cord 102 may engage the cam 96. The cord 102 may travel through guides 104 which may extend from the first hull portion 16. More specifically, the cord 102 may loop around and engage the cam 96, such that ends 106 of the cord 102 are connected to a lever system 108.

The lever system 108 may include an arm 110 that is coupled for rotation with a mount 112 that extends from (coupled to or integral with) the top 64 of the kayak 10. The arm 110 may pivot about a pin 114 in the mount 112 along a pivot axis 116 (FIG. 6). A first end 106*a* of the cord 102 may be mounted on the one side of the pivot axis 116, while the second end 106*b* of the cord 102 may be mounted at a position on a substantially opposite side of the pivot axis 116. By pivoting the arm 110 in one direction, one end 106*a* of the cord 102 may be pulled away from the stern 50 of the kayak 10. By moving the arm 110 in the other direction, the other end 106*b* of the cord 102 is pulled away from the stern 50 of the kayak 10.

In one example, moving the arm 110 toward the bow 48 of the kayak 10 moves one of the members 28, 30 associated with the lever system 108 to the open position 34. By moving the arm 110 toward the stern 50 of the kayak 10, the members 28, 30 associated with each of the lever systems 108 move to the closed position 32. It will be appreciated that the arm 110 need not be (but may be) aligned with the longitudinal axis 46 (FIG. 1), but in any case movement of the members 28, 30 is caused by movement of the arm 110. It will also be appreciated that the cord 102 remains relatively taught as the arms 110 are moved between the various positions.

Figure 7:
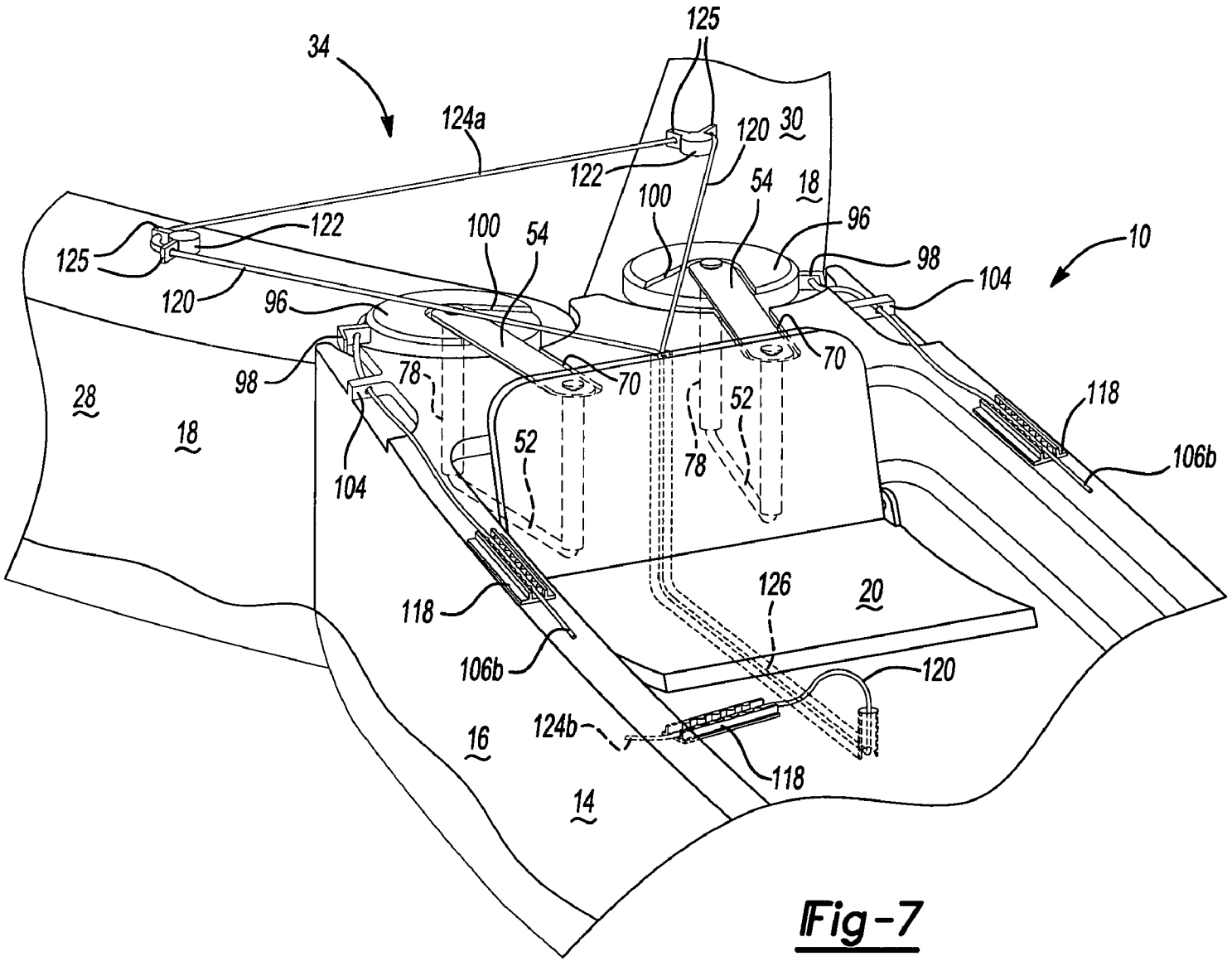
FIG. 7 is a partial perspective view of the fishing kayak of FIG. 2.
Figure 8:
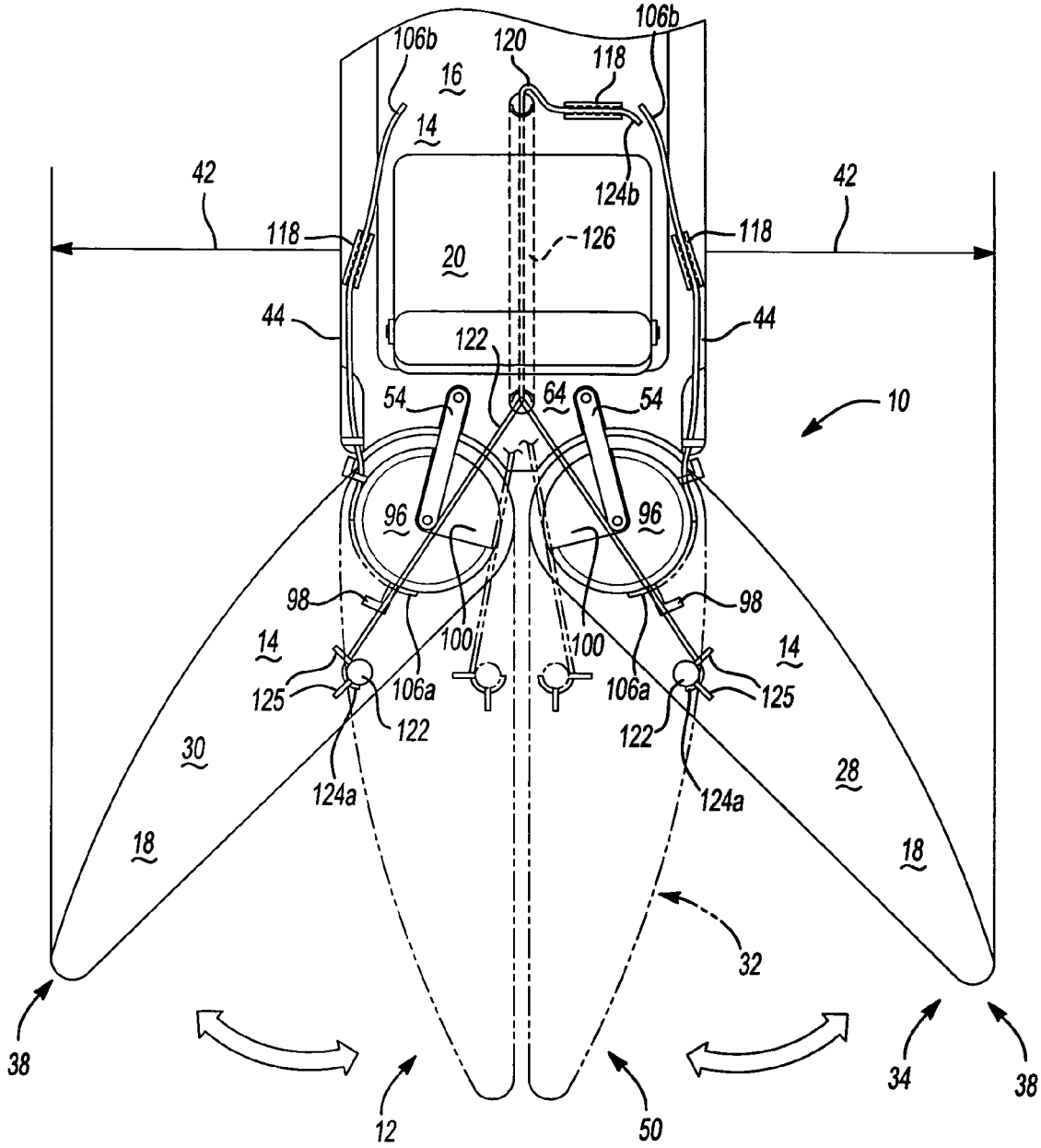
FIG. 8 is a partial top view of the fishing kayak of FIG. 2 showing movement of a first and a second member.

In one example and with reference to FIGS. 7 and 8, one end 106*a* of the cord 102 engages the catch 98 that extends from the cam 96. The other end 106*b* of the cord 102 travels through the guides 104 formed on the first hull portion 16 and the end 106*b* of the cord 102 terminates adjacent to the seat 20. A push cleat 118 or other suitable cord lock may be located adjacent to the seat 20, which may receive the end 106*b* of the cord 102. By pulling on the cord 102, the member 28, 30 that is associated with the cord 102 may be pulled from the closed position 32 toward the open position 34. As illustrated, two cords 102 may be present, which may be pulled to open the members 28, 30 to the open position 34 from the closed position 32.

An additional cord 120 may be coupled (or slidingly engaged) to a post 122 that extends from (coupled to or integral with) the members 28, 30. In one example, an end 124*a* of the cord 120 may connect to one or more catches 125 formed on the post 122. In another example, the end 124*a* may define a closed loop such that the cord 120 is threaded around the posts 122 and through the catches 125.

An opposite end 124*b* of the cord 120 may thread through a channel 126. The channel 126 may be formed behind the seat 20 and travel under the seat 20. The channel 126 may terminate in front of the seat 20. The cord 120 may travel through the channel 126 and thus the end 124*b* may come up from the channel 126 in front of the seat 20. Another push cleat 118 or other suitable cord lock may be positioned adjacent to the seat 20 to optionally capture the end 124*b*. By pulling on the cord 120, the members 28, 30 may be pulled from the open position 34 (or varying degrees thereof) to the closed position 32. With reference to FIG. 8, multiple cords 120 (and/or multiple segments) may be used and each may couple to respective posts 122. With reference to FIG. 9, the cord 120 may wrap around (or through) members 128 such that pulling on the cord 120 causes the members 28, 30 to move relative to the cord 120 and move the members 28, 30 to the closed position 32 (FIG. 8).

In one example and with reference to FIG. 6, a depression 130 may define the stop 100 formed in the cam 96. The plate 54 may move in the depression 130, as the cam 96 moves relative to the plate 54. When opening the members 28, 30 to the open position 34, the stops 100 may prevent further movement. When moving the members 28, 30 to the closed position, the stops 100 may also prevent further motion as to maintain the gap between the members 28, 30.

Figure 14:
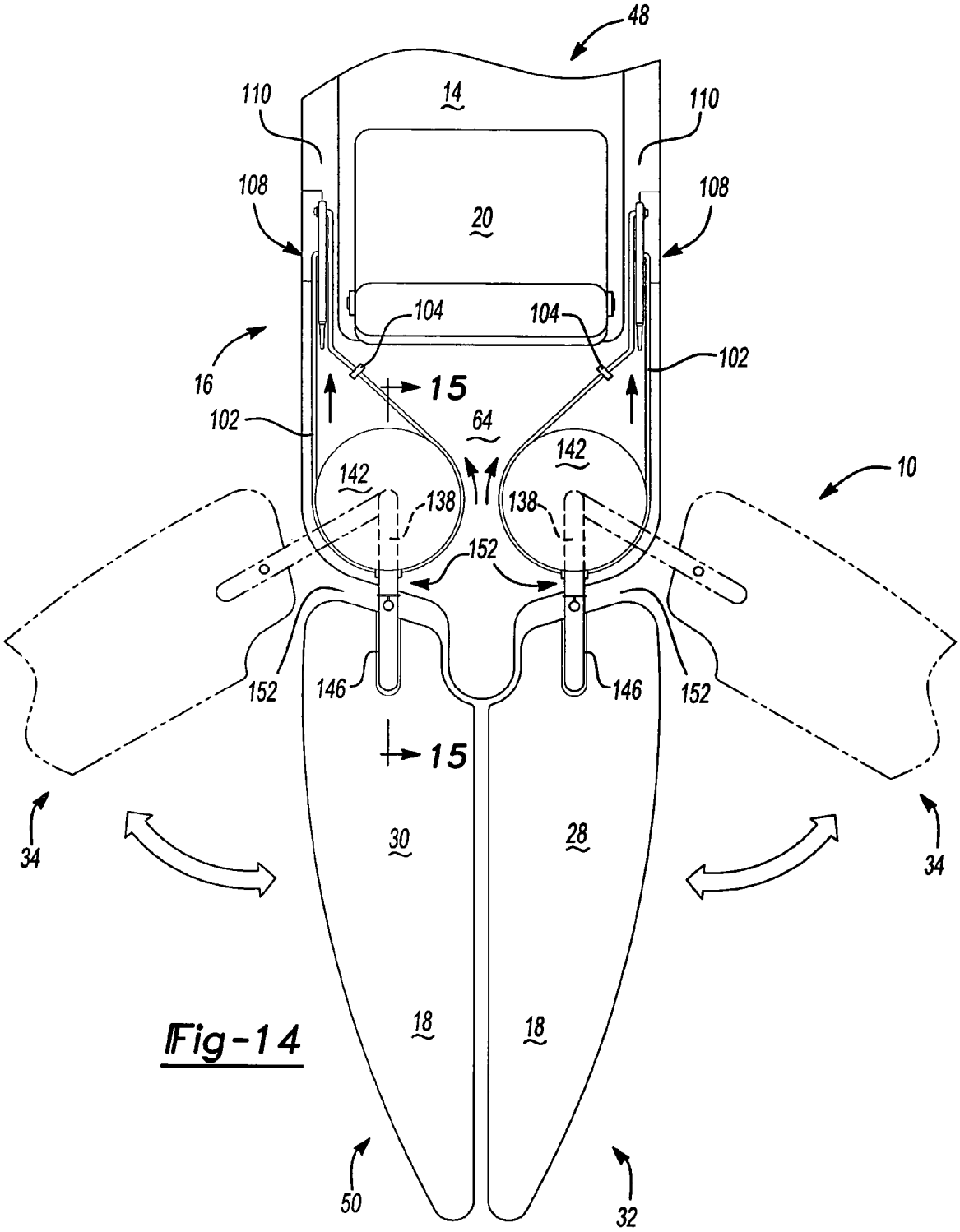
FIG. 14 is a partial top view of the fishing kayak constructed in accordance with an alternative embodiment of the present teachings.
Figure 15:
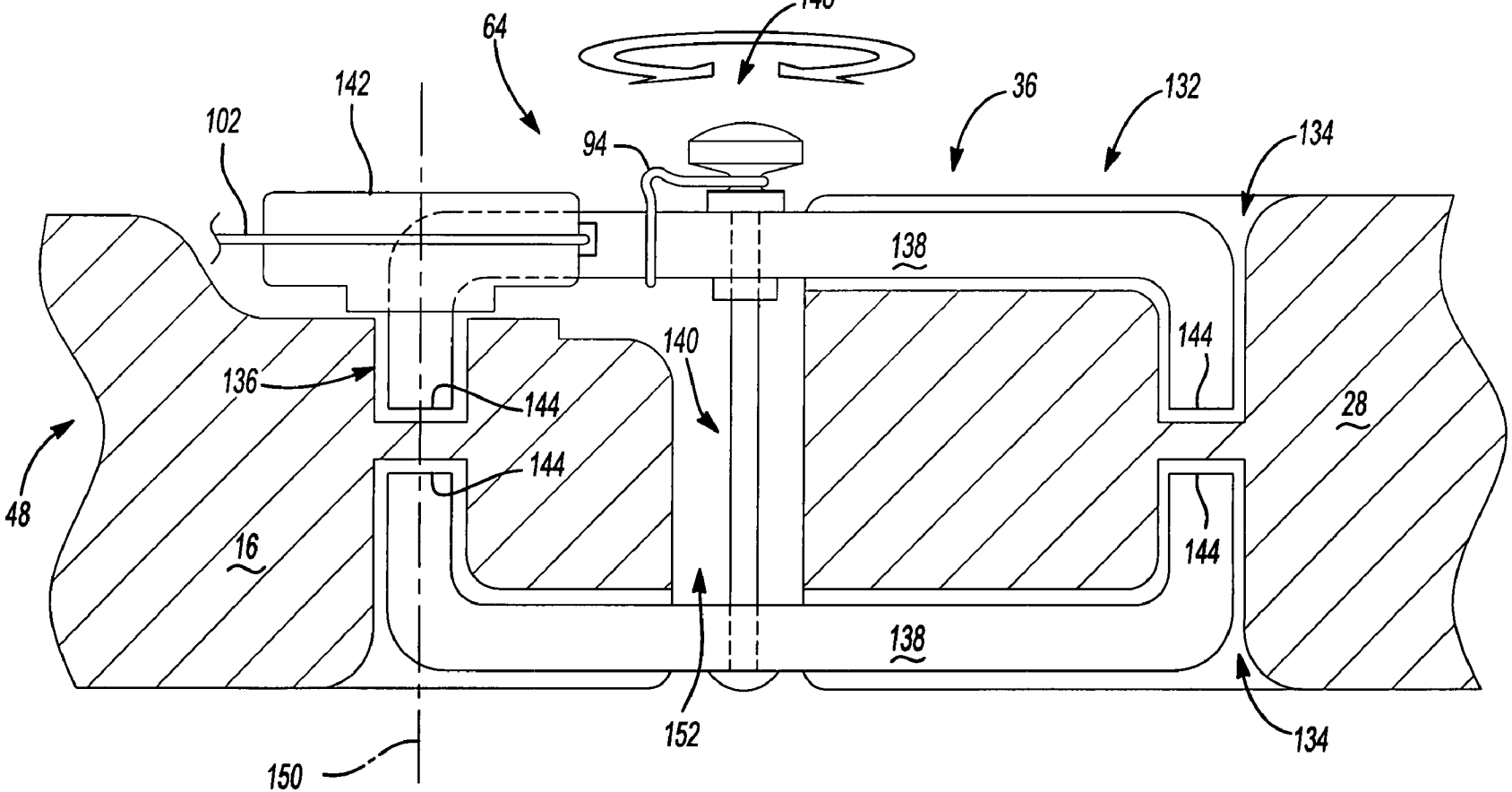
FIG. 15 is partial cross-sectional view of the first hull portion coupled to the second hull portion of the fishing kayak of FIG. 14.

In one example and with reference to FIGS. 14 and 15, the first member 28 and the second member 30 may each couple to the first hull portion 16 with a fastener assembly 132. More specifically, a pair of apertures 134 may be formed in the first end 36 of the members 28, 30. Two similar pairs of apertures 136 may be formed in the first hull portion 16 adjacent to the member 28, 30. Each of the fastener assemblies 132 (one per member 28 and 30) may include two u-shaped fasteners 138, a fastener 140 to hold the u-shaped fasteners 138 together and a cable wheel 142. Ends 144 of the u-shaped fasteners 138 may be received by the apertures 134, 136. Moreover, depressions 146 formed in the members 28, 30 receive portions of the u-shaped fasteners 138 and hold the u-shaped fasteners 138 to prevent motion relative to the members 28, 30.

By coupling a cap 148 to the fastener 140, the fastener 140 holds the u-shaped fasteners 138 together in the apertures 134, 136. The cable wheel 142 couples to the u-shaped fastener 138 disposed on the top 64 of the kayak 10 such that a center axis 150 of the cable wheel 142 is aligned with the center of the ends 144. With this arrangement, the members 28, 30 pivot about the center axis 150 and pivot about the first hull portion 16.

The cord 102 may couple the cable wheel 142 to the lever system 108. By pivoting the arm 110 of the lever system 108 in one direction, the cable wheel 142 may rotate in one direction. By moving the arm 110 in the other direction, the cable wheel 142 may rotate in the opposite direction. In one example, moving the arm 110 toward the bow 48 of the kayak 10 rotates the cable wheel 142 associated with the first member 28 in a counter-clockwise direction thus moving the first member 28 to the open position 34. Moving the arm 110 associated with the second member 30 toward the bow 48 of the kayak 10 rotates the cable wheel 142 (also associated with the second member 30) in a clockwise direction thus moving the second member 30 to the open position 34. By moving the arm(s) 110 toward the stern 50 of the kayak 10, the members 28, 30 associated with each of the lever systems 108 move to the closed position 32.

As explained in the above examples, the arm(s) 110 need not be (but may be) aligned with the longitudinal axis 46 (FIG. 1), but in any case movement of the members 28, 30 is caused by movement of the arm 110. It will also be appreciated that the cord 102 need not be associated with the lever system 108, but may be independently actuated by the user (U) and optionally locked in one or more of the push cleats 118.

The fasteners 138 are configured to space the members 28, 30 from the first hull portion 16 such that a gap 152 is formed therebetween. The gap 152 may be sized and shown to prevent debris (e.g., rocks and/or sand from a riverbed) and other items from hindering motion of the members 28, 30. The gap 152 may also be shown to allow greater degree of rotation of the members 28, 30 relative to the first hull portion 16.

In one example and with reference to FIGS. 1–3, a double-ended paddle 200 may be included with the kayak 10. The paddle 200 may be configured such that one paddle face 202 is perpendicular to the opposed paddle face 204. The paddle 200 may be collapsed and thus, for example, split in half at a mid-point 206 (FIG. 3). When the paddle 200 is uncoupled and in a split configuration the paddle 200 may be stored in one or more compartments 24, 26 formed in the kayak 10. The paddle 200 may also include spray rings 208 adjacent to the paddle blades 202, 204 that may prevent water that has accumulated on the paddle blades 202, 204 from dripping or spraying down onto the user (U). It will be appreciated that the paddle 200 may be omitted.

In one example, a pole 210 may be included with the kayak 10. The pole 210 may be a long and cylindrical member that can be collapsed into two or more portions. The pole 210 may be about 12 feet long when assembled (about 3.6 meters) and may be about 6 feet long when disassembled (about 1.8 meters). The user (U) may use the pole 210 to propel the kayak 10 by pushing against the ground and/or stationary surroundings. In one example, the pole 210 may be collapsed and stored in the compartment 24 that may be formed integrally from a portion of the kayak 10.

In one example, the kayak 10 may include an anchor boom 212. An anchor boom housing 214 may be integrally formed from the first hull portion 16. In the anchor boom housing 214, an aperture 216 may be formed that may accept a pivot pin 218. The anchor boom 212 may be coupled for rotation with the pivot pin 218 and ultimately rest in the anchor boom housing 214. The anchor boom 212 may be positioned to extend a tip 220 of the anchor boom 212 beyond the bow 48 of the kayak 10. The anchor boom 212 may have an eyelet 222 formed on (or near) the tip 220 of the anchor boom 212 through which an anchor rope 224 may be threaded.

In one example, portions of the anchor rope 224 may be held over a rope holder 226, which may extend from (coupled to or integral with) the kayak 10. The rope holder 226 may include one or more keepers 228. The keepers 228 may be rotatably coupled to a top 230 of the rope holder 226 and rotate so as to either hold or release the anchor rope 224 from the rope holder 226.

Figure 13:
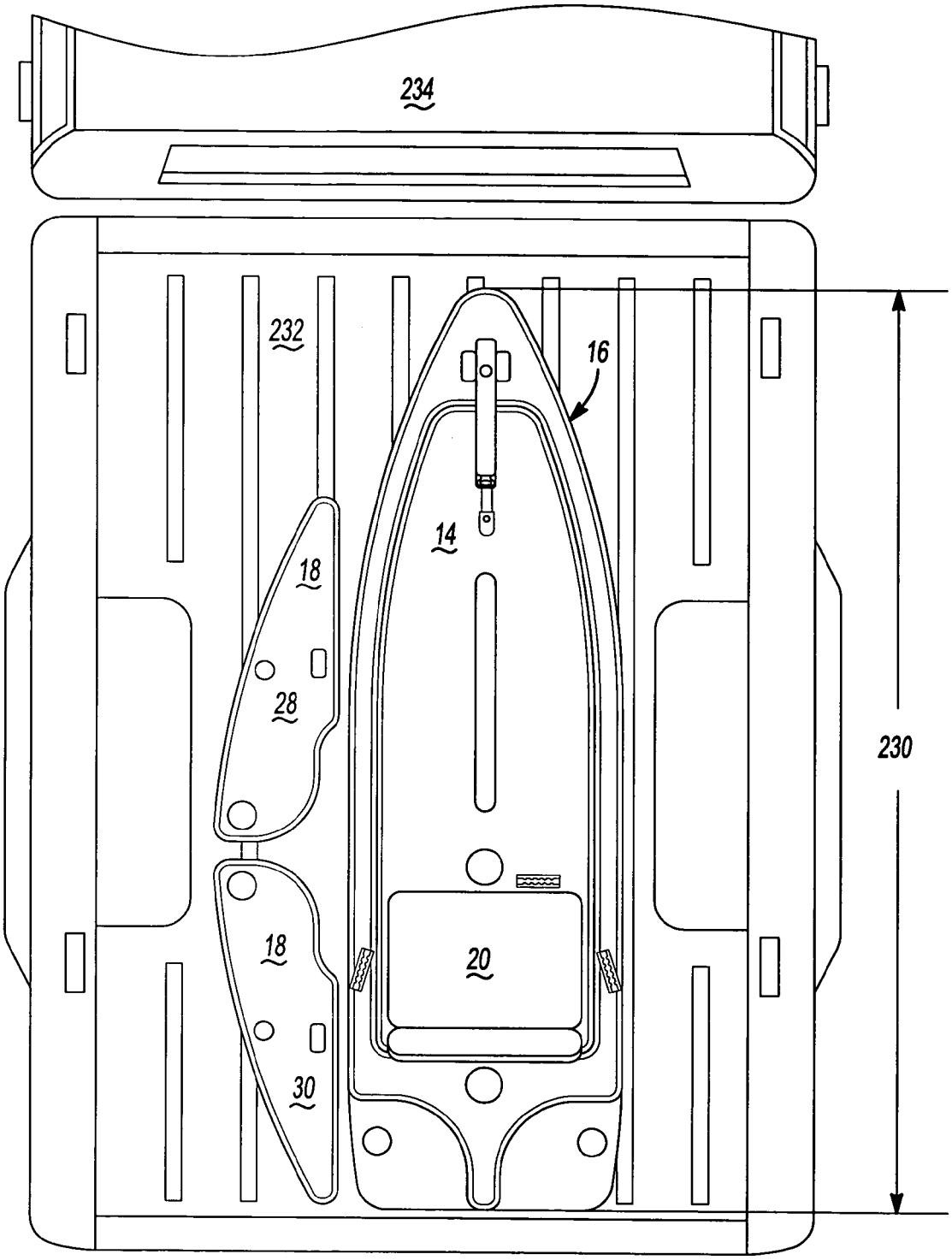
FIG. 13 is a top view of an exemplary vehicle having a cargo box in which the first hull may be transported.
Figure 16:
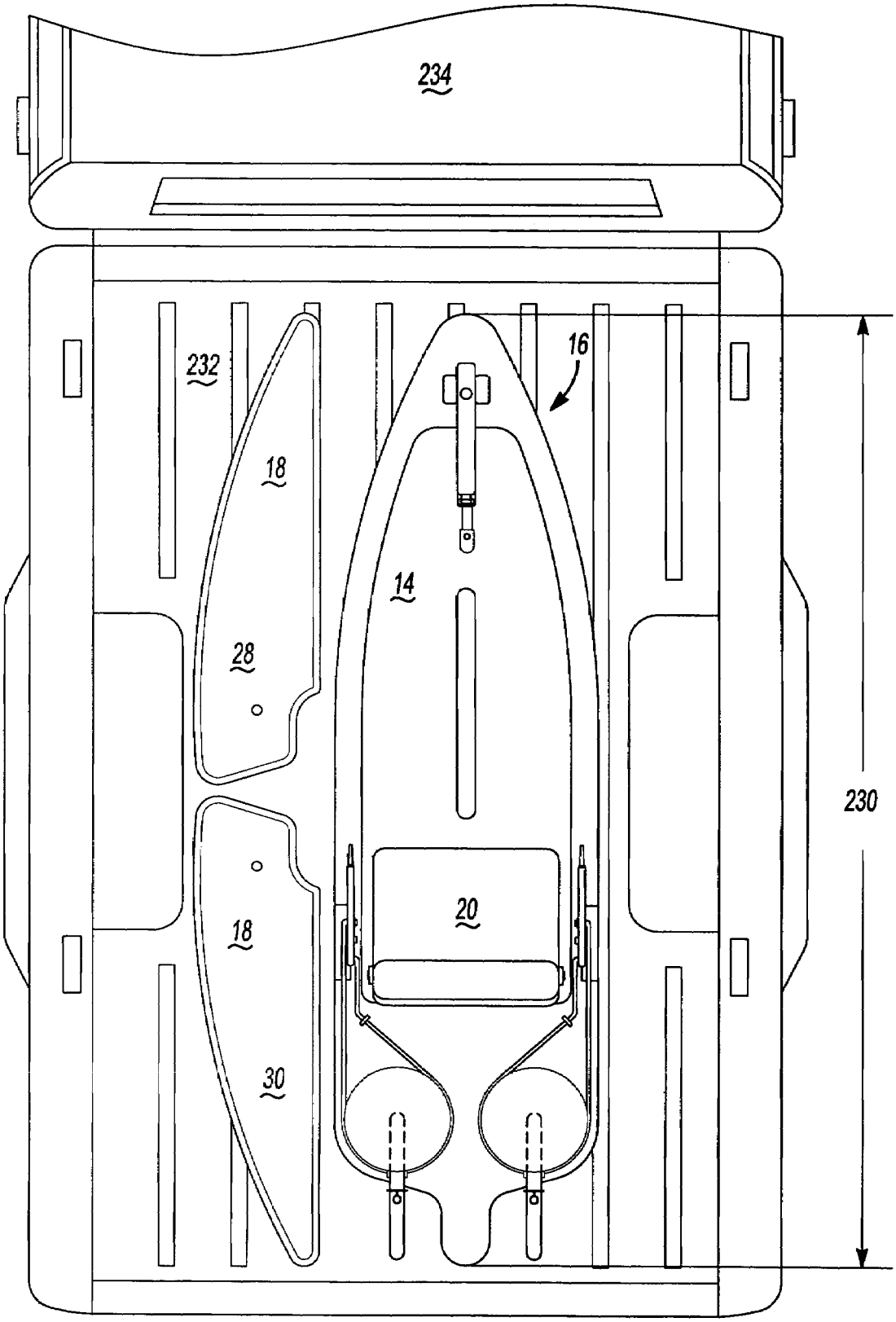
FIG. 16 is a top view of an exemplary vehicle having a cargo box in which the first hull of the fishing kayak of FIG. 14 may be transported.

In one example and with reference to FIGS. 13 and 16, a length 230 of the first hull portion 16 may be about eight feet (about 2.4 meters). The length 230 of the first hull portion 16 when decoupled from the first member 28 and the second member 30, allows the first hull portion 16 to be stowed and/or carried in a traditional cargo box 232 of a pick up traveler/car 234. It will be noted that a length of a traditional cargo box 232 of the bed is about eight feet. With the members 28, 30 decoupled from the first hull portion 16, the entire kayak 10 may be carried in the cargo box 232.

It will be appreciated that a length (L) of the kayak 10 from bow 48 (FIG. 1) to the stern 50 (a portion of which is length 230) is necessarily perpendicular to a width (W) of the kayak 10 (i.e., between gunwales 236 or between sides 44 (FIG. 1)). The largest or maximum width of the kayak 10 may be defined as a beam (B) the kayak 10 and may be located about a center of the kayak 10. The first or main hull portion 16, therefore, has forwardly tapering width and the second or stern portion 18 has a rearwardly tapering width.

The first hull portion 16 and the second hull portion 18 both have portions that when in use are below a waterline 238. When the first member 28 and the second member 30 of the second hull portion 18 move between the closed position 32 and the open position 34, portions of the members 28, 30 remain in the water and may be buoyant.

The kayak 10 may be substantially symmetrical about a longitudinally extending centerline (e.g., the longitudinal axis 46) of the kayak 10. As such, the first and second members 28, 30 may be substantially mirror images of one another about the longitudinally extending centerline of the kayak 10. When the second hull portion 18 is in the stowed or closed position 32, the kayak 10 is substantially symmetrical about a laterally extending centerline (i.e., a line about perpendicular to the longitudinal axis 46.

A universal rod holder 300 may be coupled to various portions of the kayak 10. The universal rod holder 300 is beyond the scope of the present disclosure but is disclosed in more detail in U.S. Ser. No. 11/198,940, filed on Aug. 5, 2005, entitled Rod Holder and referenced by. The above disclosure is hereby incorporated by reference as if fully set forth herein.

Those skilled in the art can now appreciate from the foregoing description that the broad teachings may be implemented in a variety of forms. Therefore, while the present teachings have been described in connection with particular examples thereof, the true scope of the present teachings should not be so limited because other modifications will become apparent to the practitioner upon a study of the drawings, the specification and the following claims.

What is claimed is:

1. A water vessel comprising:

a hull having a maximum width and defining a first portion and a second portion, each of said first and second portions having an end at which a width of said hull converges relative to said maximum width of said hull; and said second portion having a first member defining a first end and a second end, said second end is movable relative to said first end that is pivotally coupled to said first portion of said hull, said second end forming a portion of said end of said second portion that converges relative to said maximum width of said hull, wherein said first member is movable between a closed position and an open position relative to said first portion of said hull.

2. The water vessel of claim 1 wherein a portion of said first portion and said second portion of said hull are disposed beneath a waterline.

3. The water vessel of claim 1 further comprising a second member defining a first end and a second end, said first end moveably coupled to said first portion of said hull, said second end associated with said end of said second portion, wherein said second member is movable between said closed position and said open position relative to said first portion of said hull.

4. The water vessel of claim 3 wherein said second member is movable independent of said first member.

5. The water vessel of claim 1 further comprising a cam connected to said first member, wherein rotation of said cam moves said first member between said open position and said closed position.

6. The water vessel of claim 5 further comprising a lever system having a handle and a cord, said cord connected to said handle and said cam, said handle connected to said first portion of said hull, wherein moving said handle moves said first member between said open position and said closed position.

7. The water vessel of claim 1 wherein said first portion of said hull defines a length, said length less than or equal to about eight feet (about 2.4 meters).

8. The water vessel of claim 1 further comprising a fastener assembly that couples said first member to said first portion of said hull, said fastener assembly additionally connected to said hull to tether said fastener assembly to said hull when said first member is uncoupled from said first portion of said hull.

9. The water vessel of claim 1 further comprising a cable wheel and a fastener, said fastener couples said first member to said first portion of said hull, said first member pivots upon an end of said fastener associated with said first portion of said hull, said cable wheel connected to said fastener near said end of said fastener, wherein rotation of said cable wheel moves said first member between said open position and said closed position.

10. A water vessel comprising:

a hull defining a first portion and a second portion, each of said first and second portions having an end at which a width of said hull converges relative to a maximum width of said hull, said second portion defining a first member and a second member, each of said first member and said second member defining a first end and a second end, said first end of said first member and said second member pivotally coupled to said first portion of said hull, said second end of said first member and said second member converge relative to said maximum width of said hull, said first member and said second member operable in a stowed position and a deployed position, wherein said second end of said first member and said second member in said deployed position are extendable beyond said maximum width of said portion of said hull.

11. The water vessel of claim 10 wherein a portion of said first portion and said second portion of said hull are disposed beneath a waterline.

12. The water vessel of claim 10 further comprising a lever system having a handle and a cord, said cord connected to said handle and said first member, said handle connected to said first portion of said hull, wherein moving said handle moves said first member between said deployed position and said stowed position.

13. The water vessel of claim 10 wherein said hull defines at least one holder selected from a group consisting of an anchor rope holder; a cup holder, a paddle holder and a push-pole holder.

14. A water vessel comprising:

a hull having a main portion and a stern portion, said main portion defining a seat and having a forwardly tapered width, wherein said stern portion is pivotally coupled to said main portion;

said stern portion defined by first and second members, said stern portion operable in a stowed position and a deployed position, said stern portion in said stowed position has a rearwardly tapered width and in said deployed position has a width substantially greater than said width of said main portion.

15. The water vessel of claim 14 wherein said stern portion is removably coupled to said main portion.

16. The water vessel of claim 14 wherein the first and second members are substantially mirror images of one another about a longitudinally extending centerline of the water vessel.

17. The water vessel of claim 14 wherein the water vessel is substantially symmetrical about a laterally extending centerline when said stern portion is in said stowed position.

18. A water vessel comprising:

a hull having a main portion and a secondary portion each having a tapered width distal from a maximum width, said secondary portion having a first member;

a first end of said first member associated with said maximum width of said second portion, wherein said first end is pivotally coupled to said main portion at about said maximum width of said main portion;

a second end of said first member associated with said tapered width of said second portion, wherein said first member is operable in a deployed condition and a stowed condition; and a longitudinal axis of said first member forming an angle with a longitudinal axis of said main portion in said deployed condition.

* * * * *